United States Patent [19]

Senfter

[11] Patent Number: 4,884,354

[45] Date of Patent: Dec. 5, 1989

[54] SPORTS PISTOL

[75] Inventor: Emil Senfter, Lienz, Austria

[73] Assignee: Steyr-Daimler Puch AG, Vienna, Austria

[21] Appl. No.: 316,470

[22] Filed: Feb. 27, 1989

[30] Foreign Application Priority Data

Mar. 16, 1988 [AT] Austria ..... A704/88

[51] Int. Cl.[4] ..... F41C 23/00

[52] U.S. Cl. ..... 42/73; 42/75.03

[58] Field of Search ..... 42/71.01, 71.02, 73, 42/75.03

[56] References Cited

U.S. PATENT DOCUMENTS

| | | |
|---|---|---|
| 190,033 | 4/1877 | Hartley . |
| 4,300,302 | 11/1981 | Anschütz et al. . |
| 4,397,111 | 8/1983 | Morini . |
| 4,630,387 | 12/1986 | Crane et al. . |

FOREIGN PATENT DOCUMENTS

| | | |
|---|---|---|
| 2237480 | 2/1974 | Fed. Rep. of Germany . |
| 2512027 | 9/1976 | Fed. Rep. of Germany . |
| 588716 | 6/1947 | United Kingdom ..... 42/75.03 |

*Primary Examiner*—Deborah L. Kyle
*Assistant Examiner*—Richard W. Wentland
*Attorney, Agent, or Firm*—Marmorek, Guttman & Rubenstein

[57] ABSTRACT

A sports pistol comprises a housing, which extends in a substantially prismatic recess formed in a grip and is held in that recess by means of a fixing screw that extends upwardly from the bottom of the grip. In order to permit an adaptation of the pistol to the attitude of the hand of a given shooter, the housing extending in the recess defines clearances with the side faces, the bottom surface and the rear surface of the recess and is supported on the bottom surface and on the rear surface of the recess by respective pairs of adjusting screws, which are disposed on opposite sides of the vertical longitudinal center plane of the housing. Besides, the fixing screw extends at an oblique angle to the bottom surface and at an oblique angle to the rear surface of the recess and is screwed into a member that is mounted in the housing for rotation on an axis which is normal to the vertical longitudinal center plane of the housing. The fixing screw extends in a passage that is formed in the grip, opens into the recess and flares toward the recess.

1 Claim, 1 Drawing Sheet

SPORTS PISTOL

BACKGROUND OF THE INVENTION

1. Field of the Invention

This invention relates to a sports pistol comprising a housing, which extends in a substantially prismatic recess formed in a grip and is held in that recess by means of a fixing screw that extends upwardly from the bottom of the grip.

2. Description of the Prior Art

In sports competitions it is often necessary to discharge a large number of rounds within a predetermined time so that the shooter is subjected to a considerable physical strain. For this reason the shooter should be able to hold the pistol without becoming strained or tensed up while he is shooting. The barrel of the pistol should approximately be aligned with the underarm of the shooter in order to avoid a canting, the hand should assume a certain angular position relative to the underarm. But the angle between the hand and the underarm or the straight line that is defined by the barrel and the extent to which the hand is rotated to avoid a canting is not the same with all shooters but will depend on the physical conditions of each shooter. A most natural, convenient positioning of the hand so as to minimize fatigue will require for each shooter a certain position of the grip and the housing relative to each other.

In a known sports pistol of the kind described first hereinbefore the grip is rigidly connected to the housing so that the position of the two parts relative to each other cannot be changed and an optimum holding of the pistol in the hand of the shooter cannot be achieved. It is also known to provide a sports pistol for a right-handed person on the right side of the grip with a bar for supporting the side of the hand, which bar is mounted on the grip for an adjustment in an upward direction toward the barrel. That design will permit merely an adaptation to the width of the hand of the shooter but will not permit an influence to be exerted on the attitude of the hand during shooting.

In another known sports pistol (DE-A-2,512,027) the grip is also fixed by a fixing screw, which extends upwardly from the bottom of the grip, but the grip is pivoted on an axis which is normal to the vertical longitudinal center plane of the housing and is laterally rotatable about the longitudinal axis of that fixing screw. In that case the grip and the housing are held in different relative positions only by clamp screws, which cannot be used for reproducible adjustments. Besides, a slight tilting of the grip about the barrel axis is not possible at all.

DE-A-2,237,480 discloses a grip which is rotatable about an axis which is normal to the vertical longitudinal center plane of the housing. In that case the housing comprises two lateral pins, which are movably mounted in openings formed in the bipartite grip. In that case too the grip is fixed in position relative to the housing by means of clamp screws, which extend through the housing and which force the two parts of the grip against each other and against the interposed housing. A disadvantage resides in that the grip is pivotally movable only in the vertical longitudinal center plane. Whereas the pivoted grip could be held in position by means of a ball joint, which permits an adjustment of the grip in different directions, such an arrangement will have the disadvantage that a ball joint will hardly permit the position to which the grip has been adjusted to be reproduced at a later time.

SUMMARY OF THE INVENTION

It is an object of the invention to provide a sports pistol which is of the kind described first hereinbefore and which permits an optimum adaptation to the natural attitude of the shooter's hand and also permits reproducible adjustments.

That object is accomplished in accordance with the invention in that the housing extending in the recess defines clearances with the side faces, the bottom surface and the rear surface of the recess by respective pairs of adjusting screws, which are disposed on opposite sides of the vertical longitudinal center plane of the housing. Besides, the fixing screw extends at an oblique angle to the bottom surface and at an oblique angle to the rear surface of the recess and is screwed into a member that is mounted in the housing for rotation on an axis which is normal to the vertical longitudinal center plane of the housing. The fixing screw extends in a passage that is formed in the grip, opens into the recess and flares toward the recess.

The adjusting screws for supporting the housing on the bottom surface of the recess and the fixing screw can be used to adjust the elevation of the grip relative to the housing. The rearwardly extending adjusting screws can be used to adjust the inclination of the housing relative to the grip by an adjustment which is parallel to the vertical longitudinal center plane of the housing and also permit an adjustment of the housing to an inclined position relative to the axis of the barrel. When only those adjusting screws are adjusted which are provided on one side, the housing will be tilted relative to the grip on one side or the other so that a canting can be avoided even though the hand assumes an oblique position. It is apparent that the position of the housing and the grip can be adjusted relative to each other in all directions because the housing has a play in the recess of the grip in all directions and the fixing screw is screwed into a rotatable member of the housing and extends through a passage which opens into and flares toward the recess. As a result, the sports pistol in accordance with the invention is optimally adaptable to the special physical conditions of each shooter. As the convolutions of the threads of the adjusting screws can be counted, the adjustment of the grip can be reproduced with sufficient accuracy.

DETAILED DESCRIPTION OF THE PREFERRED EMBODIMENT

Figure 2:
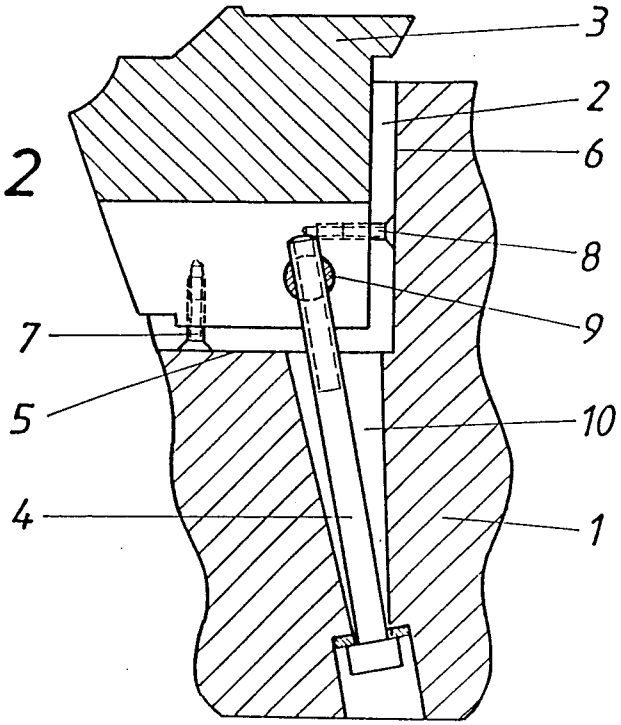
FIG. 2 is a longitudinal sectional view taken on line II—II in FIG. 1.
Figure 1:
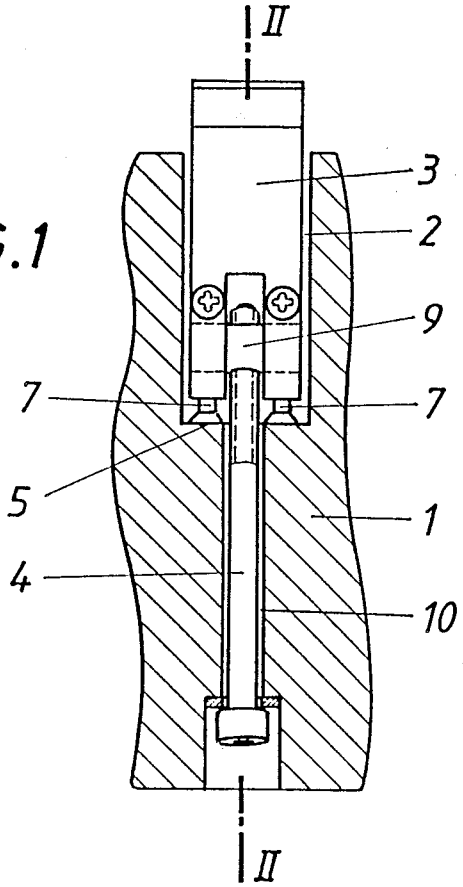
FIG. 1 is a sectional view on a plane extending through the grip transversely to the barrel axis and shows those parts of a sports pistol which are required for an understanding of the invention.

An illustrative embodiment of the invention will now be described more in detail with reference to the drawing.

The grip 1 of a sports pistol is formed with a substantially prismatic recess 2, which receives a housing or an extension 3 of the housing. To fix the housing in the grip or to fix the grip to the housing, a fixing screw 4 is provided, which extends upwardly from the bottom of the grip 1. The housing or the housing extension 3 defines clearances with the side faces, the bottom surface, and the rear surface of the recess 2. A pair of adjusting screws 7 are provided to support the housing or the housing extension 3 on the bottom surface 5 of the recess 2. A second pair of adjusting screws 8 are provided to support the housing or the housing extension 3 on the rear surface 6 of the recess 2. The two adjusting screws of each of the pairs 7, 8 are disposed on opposite sides of the vertical longitudinal center plane of the housing or the housing extension 3. That plane is indicated by the section line II—II.

The female screw threads cooperating with the fixing screw 4 are formed in a pin 9, which is mounted in the housing or the housing extension 3 for rotation on an axis that is normal to the vertical longitudinal center plane. To permit an adjustment of the housing or the housing extension 3 relative to the grip 1 in all directions, the fixing screw 4 extends through the bottom portion of the grip 1 in a passage 10, which opens into and flares toward the recess 2.

I claim:

1. A sports pistol comprising a grip, which has a bottom portion and is formed with an open-topped, substantially prismatic recess, which is defined by two side faces on opposite sides, by a bottom surface formed by said bottom portion, and by a rear surface, a housing extending from above into said recess and having a vertical longitudinal center plane, and a fixing screw, which extends upwardly through said bottom portion and into said recess and holds said housing in position in said recess, wherein said housing defines clearances with said side faces, said bottom surface and said rear surface, a first pair of adjusting screws are provided for supporting said housing on said bottom surface, a second pair of adjusting screws are provided for supporting said housing on said rear surface, the screws of each of said pairs are disposed on opposite sides of said vertical longitudinal center plane, a rotatable member having female screw threads is disposed in said recess and mounted in said housing for rotation about an axis which is normal to said vertical longitudinal center plane, said bottom portion is formed with a through passage, which opens into and flares toward said recess, and said fixing screw extends through said passage at an oblique angle to said bottom surface and at an oblique angle to said rear surface and is screwed into said female screw threads.

* * * * *